United States Patent [19]

Gunnes et al.

[11] Patent Number: 4,552,530

[45] Date of Patent: Nov. 12, 1985

[54] RING SECTION BAKING FURNACE AND PROCEDURE FOR OPERATING SAME

[75] Inventors: Kåre Gunnes, Asker; Tormod Naterstad, Årdalstangen; Olav Lid, Sunndalsøra, all of Norway

[73] Assignee: Ardal og Sunndal Verk a.s., Oslo, Norway

[21] Appl. No.: 549,546

[22] Filed: Nov. 7, 1983

[30] Foreign Application Priority Data

Nov. 5, 1982 [NO] Norway ..... 823695

[51] Int. Cl.[4] ..... F27B 5/02; F27B 5/16

[52] U.S. Cl. ..... 432/192; 432/18

[58] Field of Search ..... 432/164, 168, 192, 18, 432/249

[56] References Cited

U.S. PATENT DOCUMENTS

| | | | |
|---|---|---|---|
| 1,133,885 | 3/1915 | Richardson | 432/168 |
| 1,612,127 | 12/1926 | Johnson | 432/168 |
| 2,158,765 | 5/1939 | Stewart | 432/168 X |
| 4,040,778 | 8/1977 | Black | 432/192 |
| 4,253,823 | 3/1981 | Holdner | 432/18 |
| 4,382,778 | 5/1983 | Pealey et al. | 432/18 |

*Primary Examiner*—Edward G. Favors

*Attorney, Agent, or Firm*—Wenderoth, Lind & Ponack

[57] ABSTRACT

A ring section baking furnace for the indirect heating of shaped bodies or particulate material, particularly for calcination, includes vertical ducts, or channels, in pit walls arranged in groups by means of partition walls under the bottom of the pits. Flue gases are led up and down through these ducts. Combustion chambers are not provided, and the volume thereof otherwise required is incorporated into the pit volume. The ducts in each pit wall lead out over the pit wall into one or more separate rooms which connect, in series, two neighboring groups in this pit wall. A small cover plate is provided over each pit wall. Compared with earlier designs with the same external dimensions, less refractory brick is required, a more even temperature of the calcined material is achieved, the consumption of fuel is reduced and the capacity increased.

11 Claims, 6 Drawing Figures

RING SECTION BAKING FURNACE AND PROCEDURE FOR OPERATING SAME

BACKGROUND OF THE INVENTION

This invention relates to an arrangement for guiding the flue gases in a baking furnace of the ring section type for calcining carbon bodies, and to a procedure for operating such a furnace.

For baking carbon bodies for cells for the electrolytic reduction of alumina or for other electrometallurgical processes, special furnaces are used for the heat treatment (baking or calcining) of such carbon bodies.

The carbon bodies are made in the required shape from a mixture of crushed coke or anthracite and a binding agent which, for example, contains coils tar and pitch.

At room temperature, this mixture of coke and binder is stiff, but it becomes soft at temperatures over about 120° C., giving off low-volatile components from the binder. When subjected to further heating over a period of time, to a maximum of 1,300° C., the paste hardens, and its physical properties, such as electrical conductivity and resistence against oxidation, change.

Carbon bodies awaiting baking are usually referred to as "green carbons". These green carbons may weigh several tons and have a length of two meters or more. To prevent their becoming deformed when passing through a temperature range in which they become soft, special precautions have to be taken.

The green carbons are placed in deep pits in the furnace which is made of refractory bricks. The space between the carbons and the pit walls are filled with coke to support the carbons. Coke breeze also serves to protect the carbons against air combustion.

Several pits are built adjacent to one another, thereby forming a so-called section. In the walls between the pits there are channels, or ducts, for the flue gases. Heat is supplied to the carbons by passing the flue gases through these ducts.

The flue gases from one section pass, through ducts, to the adjacent section. In this manner, the flue gases can pass through several sections connected in series in a so-called firing zone. The usual fuels are oil or gas.

The flue gas vent and the burner manifold can be moved from section to section.

In a large ring furnace, there may well be two rows of sections built along side one another, thus forming parallel rows. At the end of a section row, the flue gas ducts are connected to the ducts in the parallel section row. In this way, the sections are joined together to form a ring. It is for this reason that such a furnace for baking carbon bodies is known as a ring section furnace.

In a ring section furnace there may be several firing zones in which the temperature is regulated according to a given program. The first sections in a firing zone have low temperature. These are followed by sections with higher temperature, while the final stage in a firing zone consists of those sections in which the carbons are cooled.

In a furnace of conventional design, each section is closed at the top by means of a section cover, and this has to be removed when green carbons are to be charged or baked carbons removed.

On account of the special properties of carbon bodies, it is necessary to avoid too large temperature gradients during baking, as these would result in cracks in the final product. Each section must therefore follow an exact time and temperature program. In the first part of the zone, the heating is up to 600° C. by the heat in the flue gases from the last part of the firing zone. Later, in the temperature range from 600° C. to the required top temperature (1,200°–1,300° C.) the heat must be supplied by the above-mentioned combustion of gas or oil.

In the cooling zone, the pit walls are cooled by air until the carbons can be removed without danger of oxidation.

Steps are taken to make the best possible use of the heat absorbed by the cooling air, by using this air for combustion.

The firing zone is moved by moving the oil or gas burners from one section to the next. The frequency of this operation is referred to as the heating cycle, and determines the capacity of the firing zone.

As already mentioned, it must also be possible to connect a gas exhaust system to a section to be connected to the firing zone. This is usually achieved by connecting a fan between this section and a pipe connection on an exhaust duct around the furnace. This exhaust duct is referred to as the flue ring main, and is kept under negative pressure by a main fan.

Before reaching the main fan, the flue gases usually pass through a scrubber which removes soot, tar vapour and other pollutants.

It is customary to differentiate between enclosed and open ring section furnaces. Enclosed ring section furnaces are usually built with vertical flue gas ducts in the pit walls. Several pits are built together, thus forming a section under a common section cover. With respect to the flue gases and the material to be calcined, the pits in a section are connected in parallel, while the sections are connected in series. There are horizontal flue gas ducts in the space below the section, while the gas flows unrestricted in the space between the section cover and the top of the pits. The flue gas ducts in the pit walls connect the spaces under the section cover with the space under the section.

With these vertical and horizontal ducts, this type of furnace has a larger total heat-transfer area than an open ring section furnace, in which the flue gas paths are restricted to the pit partition walls which are not interconnected inside each section.

Enclosed ring section furnaces have hitherto also been built with separate vertical ducts for firing, referred to as combustion chambers, to which the fuel is usually fed and combusted.

The usual practice has been that the flue gases flow vertically upwards in these combustion chambers, collect in the space under the section cover, and then flow vertically downwards in the gas ducts in the pit partition walls.

SUMMARY OF THE INVENTION

This invention is based on removing the combustion chambers, and adding the volume thus vacated to the useful volume of the pits, while at the same time the vertical ducts in each pit wall are divided into groups by means of partition walls below the bottom of the pit. Guiding of the flue gases can be carried out in that the ducts in each individual pit wall lead out over the pit wall into one or several separate space(s) which connect(s) in series two neighboring groups in this pit wall.

This latter feature also eliminates the previously used large heavy cover which embraces all the pits in the section. This one heavy section cover is replaced by smaller covers over each pit wall.

The flue gas can thus be guided in the same direction of flow in each group of ducts in the pit wall, and successively through all the groups in the pit wall.

In a preferred embodiment, the ducts in each pit wall are divided into two by means of a partition wall in the space under each pit.

When a furnace is built in this way, the fuel can be fed, fully or partly, into the space over or under the pits and/or fully or partly into the space over each pit wall.

Firing can incorporate control of combustion by arranging for there to be insufficient air in the room(s) into which the fuel is fed and then supplying more air to one or several subsequent space(s) in the direction of the flue gases.

Because this new design does not have separate spaces for firing, less space, and a smaller quantity of bricks than is the case with furnaces of the same capacity of older design, is required.

Further, in this new furnace, the heat transfer from both the upward flowing and the downward flowing flue gas will be efficient. The total length of ducting through which the gas flows per section will be considerably lengthened.

Compared with enclosed furnaces of earlier design, a furnace built according to the present invention, and of the same size (capacity) will have higher flue gas velocities in the vertical flue gas ducts, whereby the heat transfer conditions will be further improved.

The smaller volume of bricks coupled with the faster gas flow in the flue gas ducts, yet without sacrificing the advantage of guiding the flue gas flow under the section, means that a furnace built according to the present invention will result in better utilization of energy and at the same time provide a more even temperature distribution in the pit than is achieved in furnaces of earlier designs.

BRIEF DESCRIPTION OF THE DRAWINGS

The attached drawings depict a preferred embodiment of a ring section furnace in accordance with the invention, and also illustrate the method of operation thereof according to the invention.

DETAILED DESCRIPTION OF THE INVENTION

Figure 1:
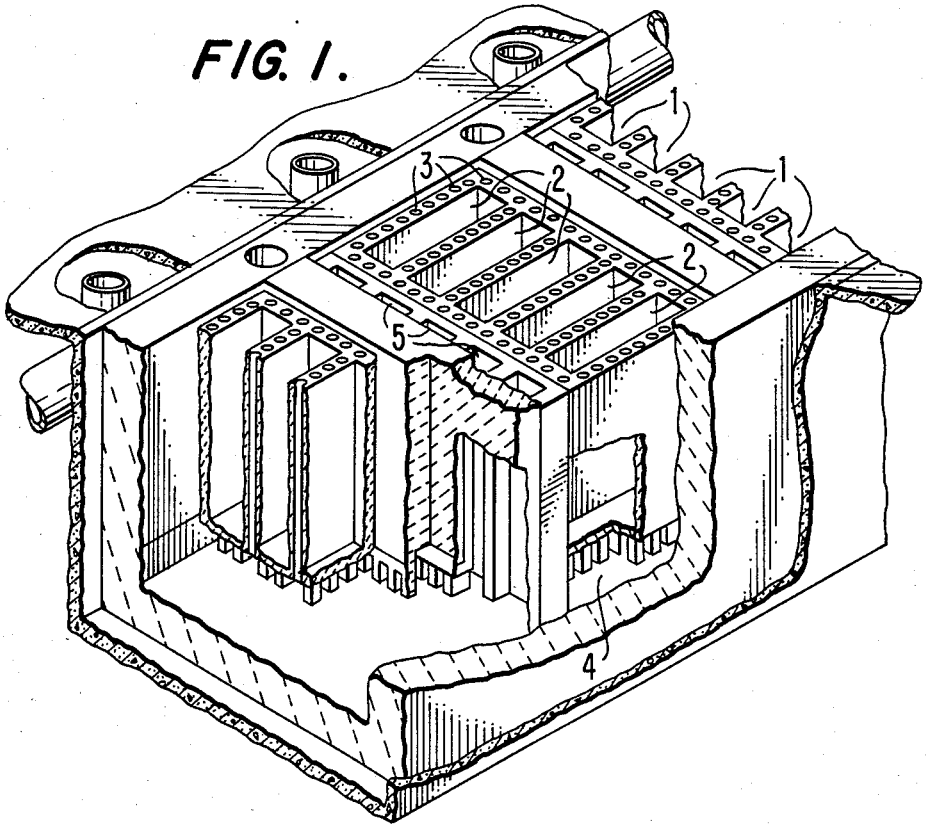
FIG. 1 is a sectional perspective view of a known section built furnace.

FIG. 1 is a partially cut-away illustration of a section of earlier design with five pits 1. In pit walls 2 there are flue gas ducts 3 through which flue gases flow downwards from the space under the section cover (not shown) and down into a space 4 under the bottom of the pits 1. The upward flow of the flue gases from below is through combustion chambers 5.

Figure 2:
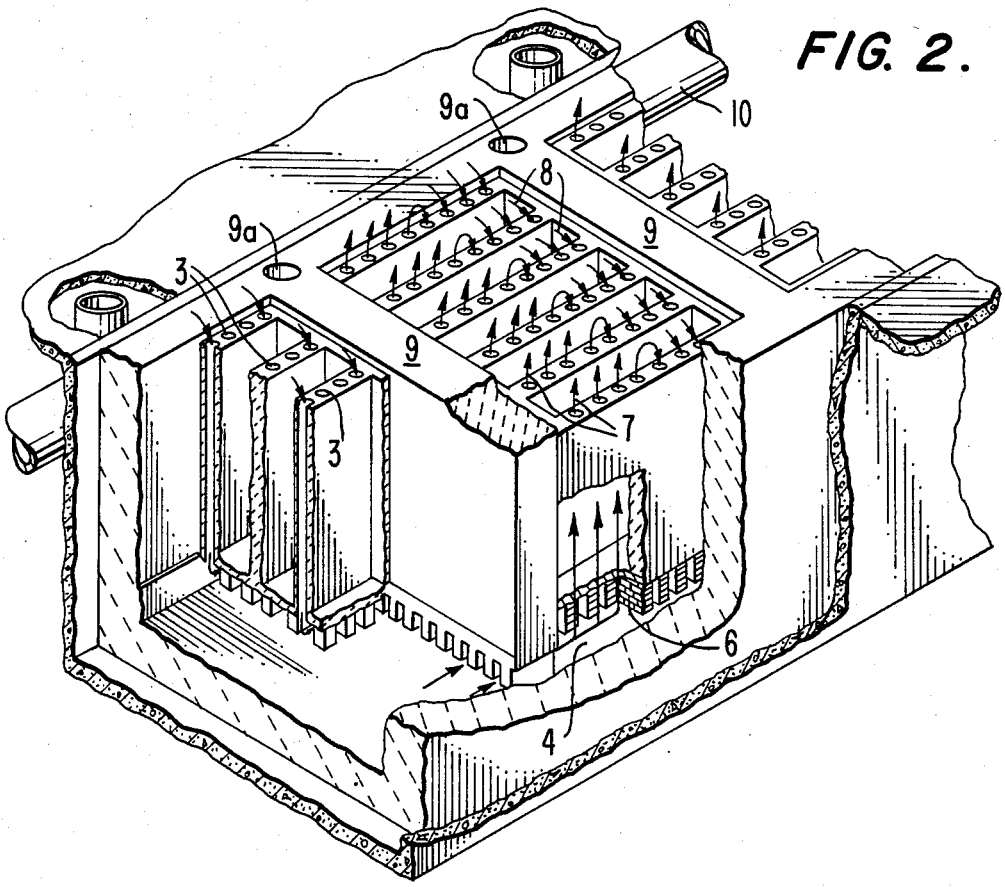
FIG. 2 is a sectional perspective view of the same furnace but built in accordance with a preferred embodiment of the invention.

In FIG. 2 is shown a similar section from which, according to the invention, the combustion chambers have been removed. Under the bottom of the pits there is provided a partition wall 6 which divides the space under the pits into two. In this manner, the flue gases flow upwardly through one group 7 of gas ducts 3 and downwardly through another group 8 thereof.

In operation, a cover plate rests on section walls 9. This cover plate is not shown, but will, in FIG. 1 as in FIG. 2, ensure that the gas flow is through the appropriate ducts.

From the space under the pits there is a duct (not shown) to pipe connector points **9*a* on the top of the furnace. These are used for connecting the individual section to the flue ring main 10**.

Firing can, as previously mentioned, be performed in several ways. The fuel can be fed, in whole or in part, into the space over or under the pits and/or in whole or in part into the space over each pit wall.

Combustion can also be achieved with insufficient air being fed to the space or spaces into which the fuel is injected; more being added in one or several space(s) downstream. By feeding air to point 4, heating can also be localized to the bottom of the pits without the fuel carbonizing.

Figure 3:
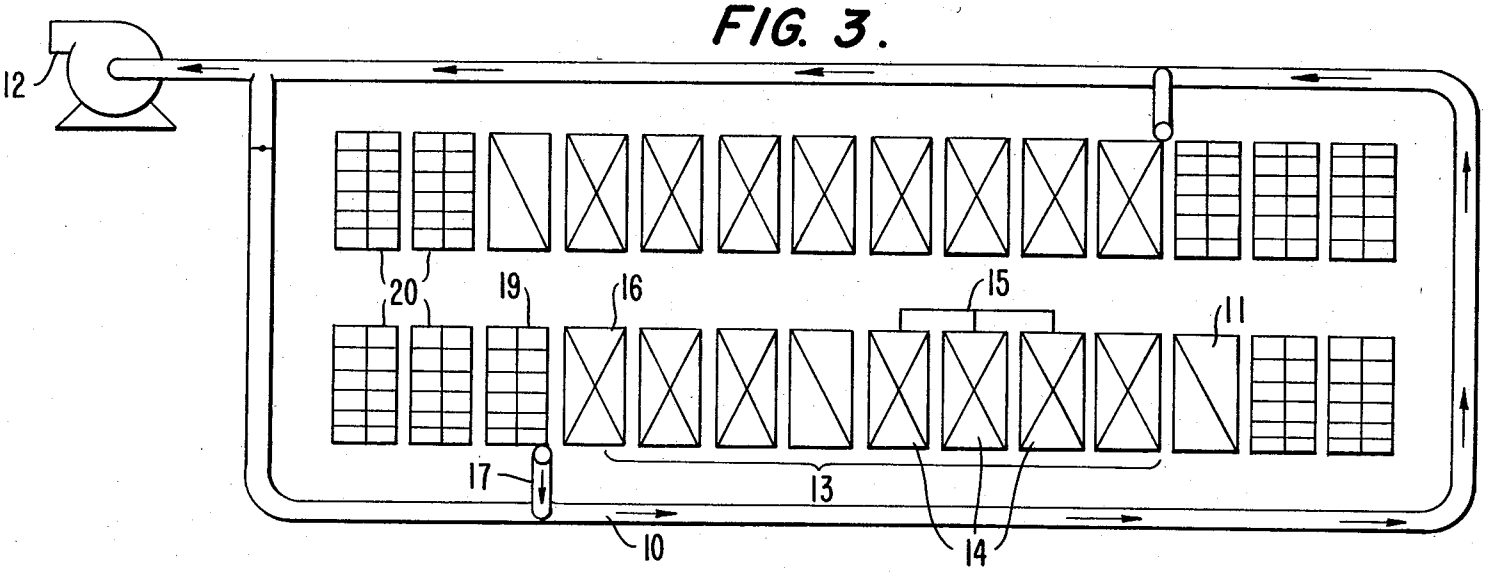
FIG. 3 is a in diagram illustrating a ring section furnace with two fire zones.

FIG. 3 is a view looking downwardly onto a ring section furnace according to the invention with two firing zones. In each of the firing zones there are combustion chambers at different stages. 11 represents a section from which the section cover has been removed. Air is being drawn in through the one half in the direction of the section in which firing is now taking place.

The carbons in this section 11 are cooled by means of air which is drawn in by an exhaust fan 12, and this air is thus preheated before it reaches the burners. 13 represents a section the top of which is sealed with a cover plate so that the cooling air from 11 is drawn through the ducts in the pit walls, upwards through the first half and downwards through the second half, up to the next sections 14 which have oil or gas burners 15.

16 indicates the section in the firing zone from which the flue gases are exhausted by means of connecting pipes 17 to the flue ring main 10. 19 indicates the section with covered gas ducts in the one half so that air cannot be drawn in in the direction opposite to the heating cycle. 20 indicates open sections from which the baked carbons are removed and the green carbons inserted. The gas scrubber and stack are not shown.

Figure 4:
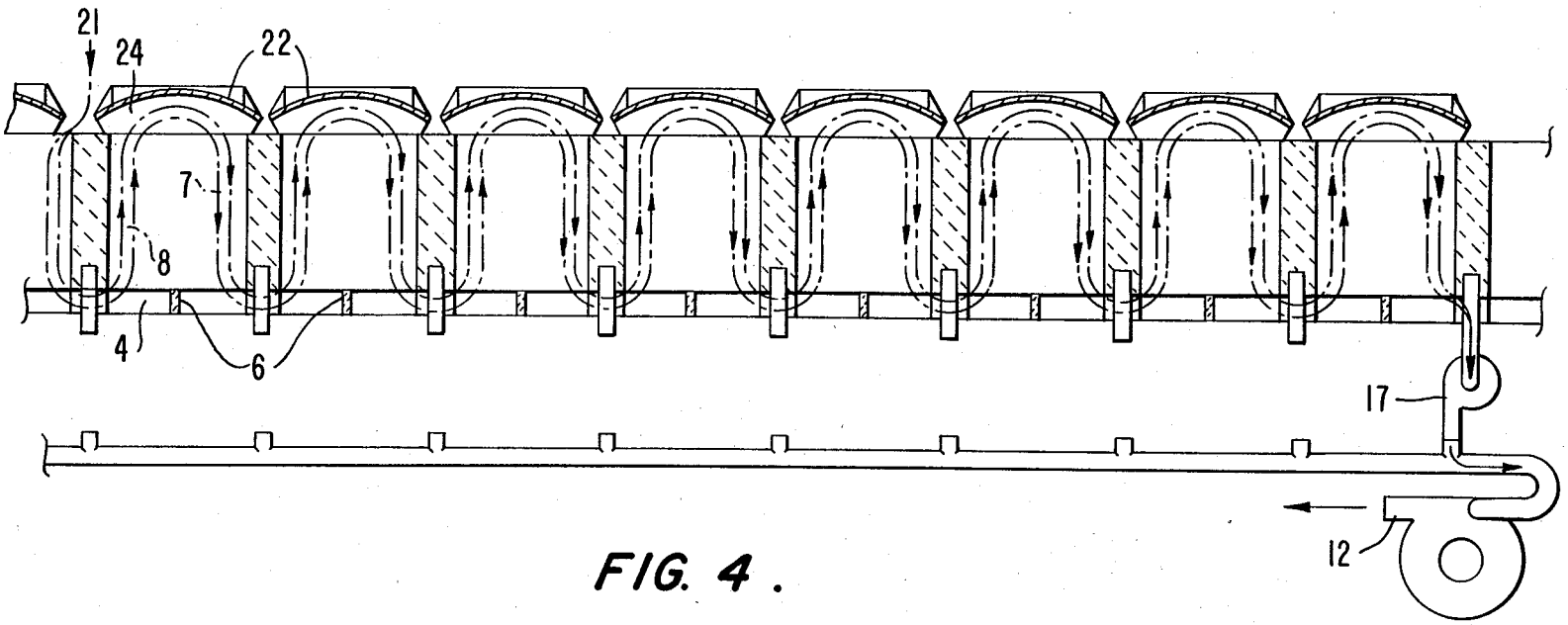
FIG. 4 is a diagram illustrating flue gas flow in a firing zone.

FIG. 4 shows, in diagram form, the gas flow in a firing zone in a ring section furnace according to the simpler embodiment of the invention. Air 21 enters the section at the left and is drawn through group 8 of gas ducts 3 down into space 4 under the bottom of the pits 1 of such section and is led through ducts in wall 9 to the next section with cover plate 22 which closes off space 24.

Here, the flue gases are drawn up through the ducts 3 in the first half 7 of the section and down through the ducts 3 in the pit walls in the other half 8, and then on to the next section.

Figure 5:
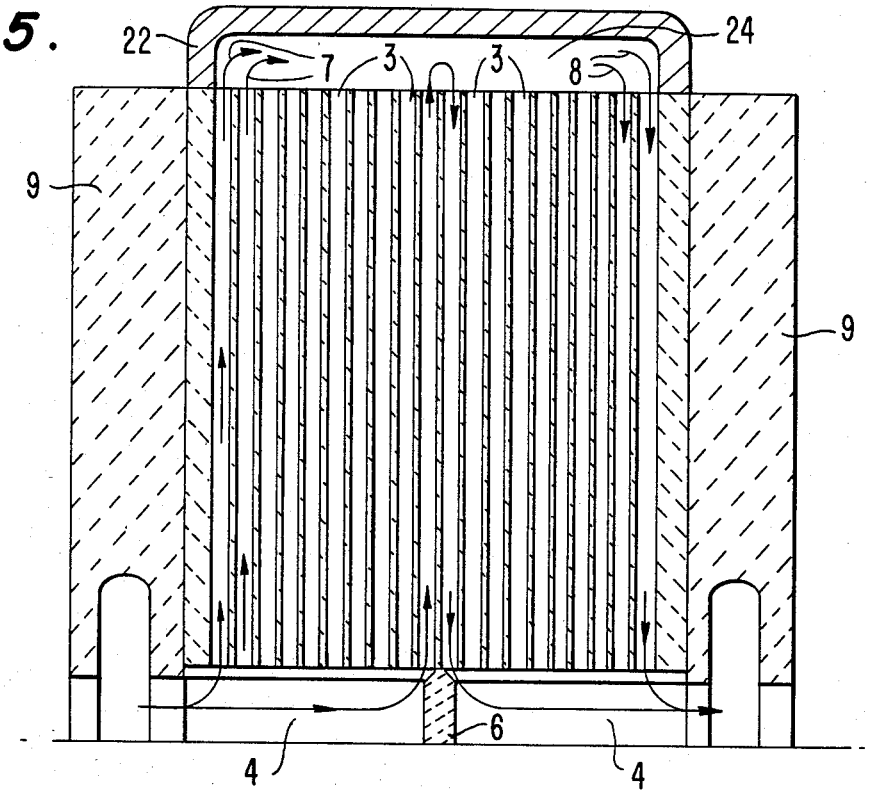
FIG. 5 is a longitudinal section showing the flue gas flow in a pit wall with a separate lid over the openings in flue gas ducts.

FIG. 5 is a longitudinal section of a pit wall 2 in which the flue gases are drawn up through the gas ducts 3 in group 7 and down through the gas ducts 3 in group 8. Under the pit, space 4 is divided into two by means of a partition wall 6. Over the section walls 9 is shown the cover plate 22 which seals off space 24 over the pit wall.

Figure 6:
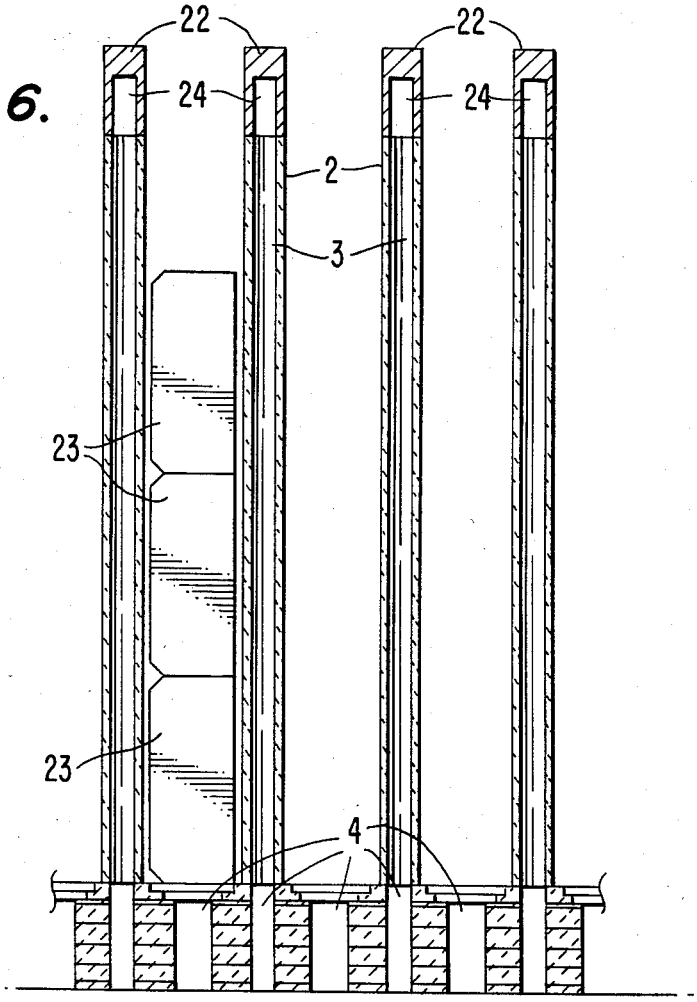
FIG. 6 is a cross-section of the pit walls in a section with separate lids over the pit walls.

FIG. 6 is a cross-section of a part of a furnace section with four pit walls 2 shown in section. In one of the pits 1 there are three carbon bodies 23. Over each pit wall 2 there is a space 24 which connects the two groups 7, 8 of flue gas ducts 3 in such pit wall. Attention is drawn to the fact that, with such a space 24 over each pit wall, there is no common cover (lid) over the entire section.

On account of the partition wall 6 which divides space 4 into two parts, the flue gases will flow up and down in the same pit wall.

The essence of the invention is thus the removal of the combustion chambers through which the flue gases in a conventional ring section furnace flow to the top of the pits and into which the fuel is normally injected. In a preferred embodiment, the gas is led up through the ducts in one half of the pit wall by means of an impervious partition wall in the space beneath the pits. Under the section cover, the gases are deflected and again flow down under the furnace, but now on the other side of the impervious partition wall 6. From here the gases go on to the next section.

This procedure offers several advantages.

The efficiency of the furnace is much increased because the volume of the combustion chambers can now be built into the pits. In this manner, the capacity of the furnace is increased.

By reducing the volume of refractory bricks per unit produced, the energy lost to the refractory materials is reduced, thus saving fuel.

The gas velocity through the section increases. This results in a more even temperature distribution in the section, and this reduces the danger of the carbons cracking. This makes it possible to advance the firing zone at short intervals, which in turn increases the capacity of the furnace.

Further, the method of the invention permits a better localization of fuel injection. This allows better control of the temperature cycle which in turn leads to a more uniform calcination of the carbons, and better possibility of advancing the heating cycle more rapidly which also helps to increase capacity.

It will be understood that a furnace according to the invention will also, with advantage, be able to be used in connection with all indirect heating of shaped bodies surrounded by a particulate technical material, or by a particulate material alone.

We claim:

1. In a ring section furnace of the type including a plurality of sections connected in series, each said section comprising a plurality of parallel pits defined by spaced parallel pit walls, and vertical ducts provided in each said pit wall, with flue gases being passed through said ducts to achieve heat treatment by indirect heat exchange with material to be treated placed in said pits, the improvement comprising:

means for segregating said ducts of each said pit wall into separate groups of ducts and thereby for causing the flue gas to pass both upwardly and downwardly through respective said ducts in each said pit wall.

2. The improvement claimed in claim 7, wherein each said pit wall has therebeneath a lower space, and said means comprises a partition wall dividing each said lower space into first and second lower chambers respectively connected to first and second said groups of ducts.

3. The improvement claimed in claim 2, further comprising means defining an upper space above each said pit wall, said upper space being connected to both said first and second groups of ducts, such that the flue gas flows from said first lower chamber upwardly through said first group of ducts into said upper space, and from said upper space downwardly through said second group of ducts into said second lower chamber.

4. The improvement claimed in claim 3, wherein adjacent said sections are separated by section walls, and further comprising horizontal ducts extending through lower portions of said section walls and connecting the said second lower spaces of one said section with the said first lower spaces of the adjacent downstream said section taken in the direction of flow of the flue gas.

5. The improvement claimed in claim 3, wherein said upper space defining means comprises a cover plate fixed above each said pit wall.

6. In a process for heat treating material to be treated by the operation of a ring section furnace of the type including a plurality of sections connected in series, each said section comprising a plurality of parallel pits defined by parallel pit walls, and vertical ducts provided in each said pit wall, said process comprising positioning said material in said pits, combusting a fuel to form flue gas, and passing said flue gas through said ducts, thereby treating said material by indirect heat exchange, the improvement comprising:

segregating said ducts of each said pit wall into separate groups of ducts, and passing said flue gas both upwardly and downwardly through respective said ducts in each said pit wall.

7. The improvement claimed in claim 6, wherein each said pit wall has therebeneath a lower space, and said segregating comprises dividing each said lower space into first and second lower chambers respectively connected to first and second said groups of ducts.

8. The improvement clamed in claim 7, further comprising providing above each said pit wall an upper space connected to both said first and second groups of ducts, and passing said flue gas to flow from said first lower chamber upwardly through said first group of ducts into said upper space, and from said upper space downwardly through said second group of ducts into said second lower chamber.

9. The improvement claimed in claim 8, wherein said furnace includes section walls separating adjacent said sections, and further comprising passing said flue gas from said second lower chambers of one said section through horizontal ducts in the respective said section wall into said first lower chambers of the adjacent downstream said section taken in the direction of flow of said flue gas.

10. The improvement claimed in claim 6, comprising combusting said fuel in at least one of said upper spaces and spaces in said pits above and below said material.

11. The improvement claimed in claim 10, comprising conducting said combustion with insufficient air for complete combustion, and introducing additional air at at least one downstream position.

* * * * *